US007404626B2

(12) United States Patent
Piatt et al.

(10) Patent No.: US 7,404,626 B2
(45) Date of Patent: Jul. 29, 2008

(54) METHOD FOR DROP BREAKOFF LENGTH CONTROL IN A HIGH RESOLUTION INK JET PRINTER

(75) Inventors: Michael J. Piatt, Dayton, OH (US); Randy L. Fagerquist, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 496 days.

(21) Appl. No.: 11/229,459

(22) Filed: Sep. 16, 2005

(65) Prior Publication Data

US 2007/0064065 A1 Mar. 22, 2007

(51) Int. Cl.
*B41J 2/085* (2006.01)

(52) U.S. Cl. ..... 347/76

(58) Field of Classification Search ..... None
See application file for complete search history.

(56) References Cited

U.S. PATENT DOCUMENTS

| | | | | |
|---|---|---|---|---|
| 3,709,432 | A | 1/1973 | Robertson | |
| 4,302,761 | A | 11/1981 | Yamamoto | |
| 4,613,871 | A | 9/1986 | Katerberg | |
| 4,972,201 | A * | 11/1990 | Katerberg et al. | 347/76 |
| 2006/0055746 | A1 * | 3/2006 | Weksler et al. | 347/77 |
| 2007/0126799 | A1 * | 6/2007 | Steiner | 347/55 |

FOREIGN PATENT DOCUMENTS

| | | |
|---|---|---|
| EP | 1 277 579 | 1/2003 |
| JP | 60-087058 | 5/1985 |

OTHER PUBLICATIONS

D.J. Drake, Binary Continuous Thermal Ink Jet Break Off Length Modulation, Xerox Disclosure Journal, Xerox Corporation, Stamford, Conn., vol. 14, No. 3, May 1, 1989, pp. 95-100, XP000027460.

* cited by examiner

*Primary Examiner*—K. Feggins
(74) *Attorney, Agent, or Firm*—Buskop Law Group, PC

(57) ABSTRACT

An inkjet printing system having a plurality of inkjets, wherein the inkjets are disposed in a row and directed toward a media, wherein the printhead includes a drop generator having an orifice plate, wherein the orifice plate has nozzles with a first and second group forming an inkjet, wherein the first group is in interleaved patterns with the second group, and the geometry of the first group is different from the second group. A stimulating device provides a signal to the continuous inkjets to produce a first and second group of drops with a first and a second breakoff length, wherein the first and second breakoff lengths are different; a charge plate with drop charging electrodes positioned adjacent each inkjet opposite the drop generator. A controller in communication with each drop charging electrode adapted to supply a pulse to each electrode to isolate the first and second group of drops.

11 Claims, 7 Drawing Sheets

METHOD FOR DROP BREAKOFF LENGTH CONTROL IN A HIGH RESOLUTION INK JET PRINTER

CROSS REFERENCE TO RELATED APPLICATIONS

Reference is made to commonly assigned, U.S. patent application Ser. No. 11/229,467 filed concurrently herewith, entitled "INK JET BREAK-OFF LENGTH CONTROLLED DYNAMICALLY BY INDIVIDUAL JET STIMULATION," in the name of Gilbert A. Hawkins et al.; U.S. patent application Ser. No. 11/229,454 filed concurrently herewith, entitled "INK JET BREAK-OFF LENGTH MEASUREMENT APPARATUS AND METHOD," in the name of Gilbert A. Hawkins et al.; U.S. patent application Ser. No. 11/229,263 filed concurrently herewith, entitled "CONTINUOUS INK JET APPARATUS WITH INTEGRATED DROP ACTION DEVICES AND CONTROL CIRCUITRY," in the name of Michael J. Piatt, et al.; U.S. patent application Ser. No. 11/229,261 filed concurrently herewith, entitled "CONTINUOUS INK JET APPARATUS AND METHOD USING A PLURALITY OF BREAK-OFF TIMES", in the name of Michael J. Piatt et al.; and U.S. patent application Ser. No. 11/229,456 filed concurrently herewith, entitled "IMPROVED INK JET PRINTING DEVICE WITH IMPROVED DROP SELECTION CONTROL", in the name of James A. Katerberg, the disclosures of all of which are incorporated herein by reference.

FIELD OF THE INVENTION

The present embodiments relate to inkjet printing and methods to reduce cross talk and physical interference of droplet in a high resolution linear array of an ink jet printer.

BACKGROUND OF THE INVENTION

A need exists for controlling drop break off lengths in ink jet controllers because of cross talk and physical interference of drops in an ink jet printer.

The present embodiments described herein were designed to meet these needs.

SUMMARY OF THE INVENTION

The present embodiments describe an ink jet printing system having a printhead including a plurality of continuous ink jets. The continuous ink jets are disposed in a row and directed toward a print media. The printhead has a drop generator with an orifice plate disposed thereon, wherein the orifice plate comprises a plurality of nozzles with each nozzle forming an ink jet, wherein the plurality of nozzles contain a first group of nozzles and a second group of nozzles, wherein the first group is in interleaved patterns with the second group, and wherein the geometry of the first group is different from the geometry of the second group. The printhead also has a stimulating device adapted to provide a signal to the continuous ink jets to produce a first group of drops with a first breakoff length and a second group of drops with a second breakoff length, wherein the first and the second breakoff lengths are different.

A charge plate is disposed opposite the drop generator, wherein the charge plate comprises a plurality of drop charging electrodes, wherein each drop charging electrode is positioned adjacent each ink jet. A controller is in communication with each drop charging electrode, wherein the controller is adapted to supply a controlled drop selection pulse to each drop charging electrode (not electrodes), wherein the controlled drop selection pulse enables the first group of drops to be isolated from the second group of drops.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The present embodiments provide a method to improve physical droplet separation between adjacent drops in a high resolution linear array ink jet printing system. The methods provide better image quality, higher resolution printing, fewer artifacts, and better drop selection due to reduced cross talk interaction.

The embodied systems and methods reduce splash and waste from incorrect or unnecessary ink drops form encountering print media. The embodiments reduce provides a significant environmental advantage by reducing media waste.

The embodied systems and methods reduce the amount of ink needed per page because the embodiments provide more uniform coverage using smaller drops at same print density. The reduction in the amount of ink promotes less cockle and curl in the paper due to reduced ink content. Additionally, paper printed with this technique and system is easier to recycle with a reduced ink load.

Figure 1:
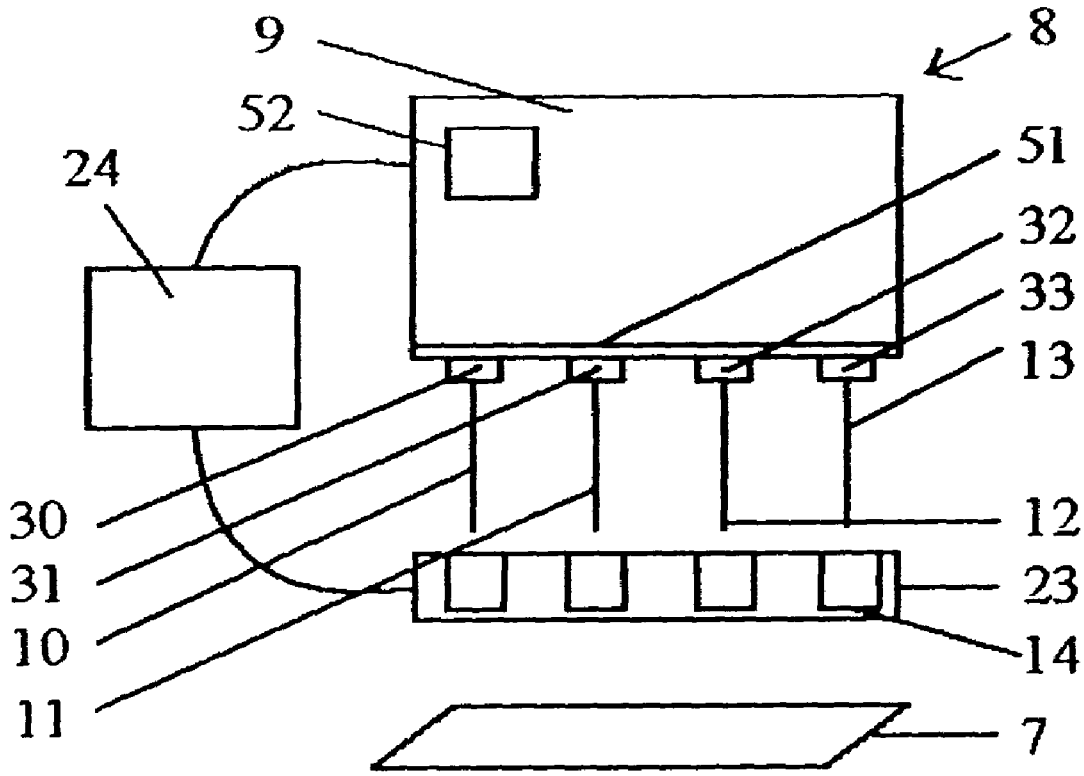
FIG. 1 is a schematic of a printhead useable in the embodied system.

With reference to the figures, FIG. 1 depicts a detail of the ink jet printing system with a printhead 8 with a drop generator 9, an orifice plate 51, and a charge plate 23. The printhead 8 includes continuous ink jets 10, 11, 12, and 13 that form a jet array. The continuous ink jets 10, 11, 12, and 13 are disposed in a row and directed toward a print media 7. The orifice plate 51 has a numerous nozzles 30, 31, 32, and 33 arranged in an array, wherein the nozzles 30, 31, 32, and 33 are the source of the continuous ink jets 10, 11, 12, and 13.

A stimulating device is connected to the drop generator 9 to stimulate a first group of ink jets to produce a first group of synchronous drop breakoffs, as depicted in FIG. 1. The same or different stimulating device stimulates one or more second groups of ink jets to produce one or more second groups of synchronous drop breakoffs that have a different break off length from the orifice plate than the first group of synchronous drop break offs.

Continuing with FIG. 1, a charge plate 23 is disposed below the drop generator 9. The charge plate 23 comprises a plurality of drop charging electrodes. Each drop charging electrode is positioned adjacent an ink jet. Alternatively, the electrode 14 can be fabricated on the charge plate 23 on a face adjacent the jet 10. The jet 10 emits a drop 19 that is affected by the electrode A controller 24 is in communication with each drop charging electrode. The controller 24 supplies a plurality of synchronized controlled drop selection pulses to the drop charging electrodes, such as electrode 14 exampled in FIG. 1.

Figure 2:
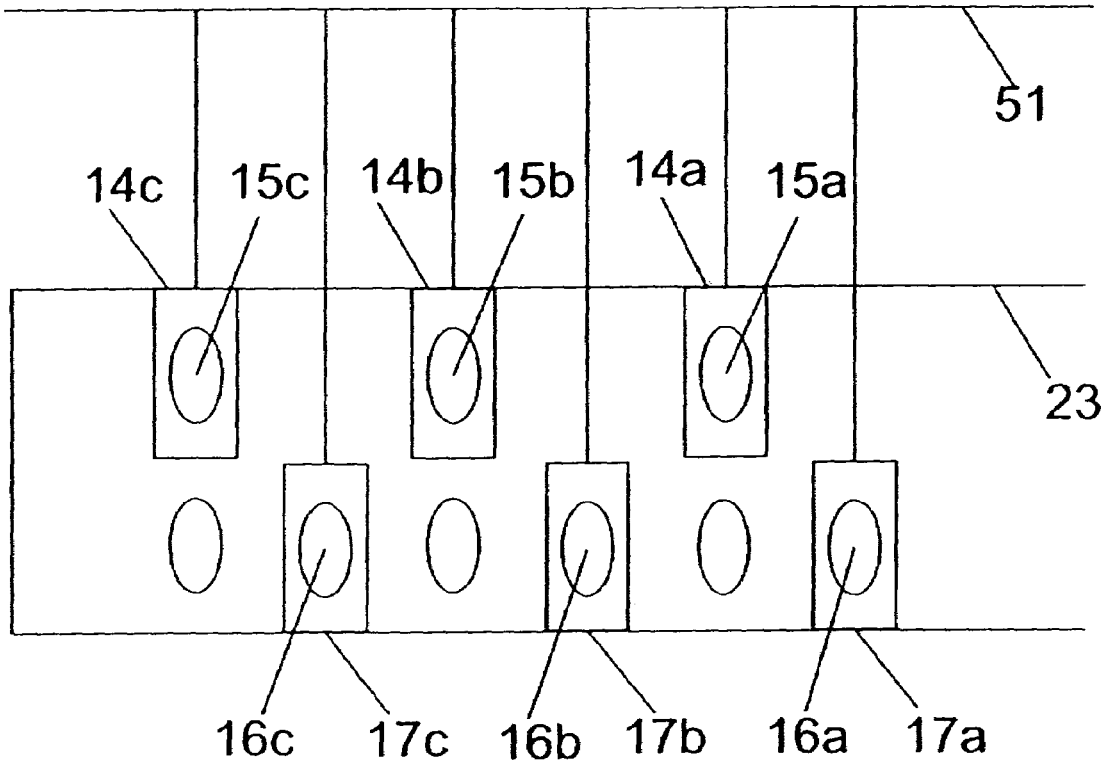
FIG. 2 depicts a front view of the drop break off from the ink jets.

FIG. 2 depicts a first group of drop breakoff lengths 15*a*, 15*b*, and 15*c*. The charge plate 23 comprises a plurality of drop charging electrodes 14*a*, 14*b*, and 14*c*. The first group of drop breakoff lengths 15*a*, 15*b*, and 15*c* has a first length associated with a first group of drop charging electrodes 14*a*, 14*b*, and 14*c* positioned at that first drop break off length. A second group of drop break off lengths 16*a*, 16*b*, and 16*c* has a second length associated with a second group of drop charging electrodes 17*a*, 17*b*, and 17*c* positioned at the second drop break off length. In one embodiment, the stimulating device provides one signal to both sets of jets in the array. The filament length of adjacent jets varies in the same relationship as the positioning of the drop charging electrodes on the charge plate so that each jet breaks up into droplets in front of the corresponding electrode. In an alternative embodiment, each drop selection pulse has a pulse width that prevents interference with the drop selection pulse used for the continuous ink jets adjacent to the drop selection pulse. A drop creation period is formed between the first drops of the first group and an additional drop of that group. The pulse width for each ink jet is about 50% the drop creation period in a preferred embodiment.

In one embodiment, the nozzles associated with the first group of ink jets have a first diameter and the nozzles associated with the second group of ink jets comprise a second diameter. The first diameter is typically greater than the second diameter. In an alternative embodiment, the nozzles associated with the first group of ink jets have a first depth and the nozzles associated with the second group of ink jets have a second depth. Typically, the first depth is greater than the second depth. In still another embodiment, the nozzles can each have a nozzle entrance, wherein the first group of ink jets has a radius of curvature at the nozzle entrance that is different from the nozzles associated with the second group of ink jets. In still another embodiment, the nozzles can have a nozzle exit, wherein the first group of ink jets that has a radius of curvature of the nozzle exit different from the nozzles associated with the second group of ink jets. In all embodiments, the stimulating device is adapted to vibrate the nozzles associated with both groups synchronously. The nozzle vibration serves as a signal to stimulate drop breakoff from the ink jets.

In yet another embodiment, the nozzles associated with the first group of ink jets have a first diameter and the nozzles associated with the second group of ink jets have a second diameter. The first diameter is typically greater than the second diameter. The still another embodiment, the nozzles associated with the first group of ink jets comprise a first height and the nozzles associated with the second group of ink jets comprise a second height. The first height is typically greater than the second height. In another embodiment, the nozzles can have a nozzle entrance, and the nozzles associated with the first group of ink jets can have a radius of curvature of the nozzle entrance different from the nozzles associated with the second group of ink jets. In still another embodiment, the nozzles can have a nozzle exit. The nozzles associated with the first group of ink jets have a radius of curvature of the nozzle exit different from the nozzles associated with the second group of ink jets. In these embodiments, the stimulating device is adapted to apply a pressure modulation to the ink supplied to the nozzles of both groups synchronously. The pressure modulation serves as a signal to stimulate drop breakoff from the ink jets.

In an embodiment, the drop charging electrodes can be positioned adjacent each ink jet. Typically, the drop charging electrodes are positioned at the same height. Alternatively, the drop charging electrodes can be positioned at different heights. For example, a first group of drop charging electrodes can be positioned at a first height adjacent a first drop breakoff length and a second group of drop charging electrodes can be positioned at a second height adjacent a second drop breakoff length.

Figure 3:
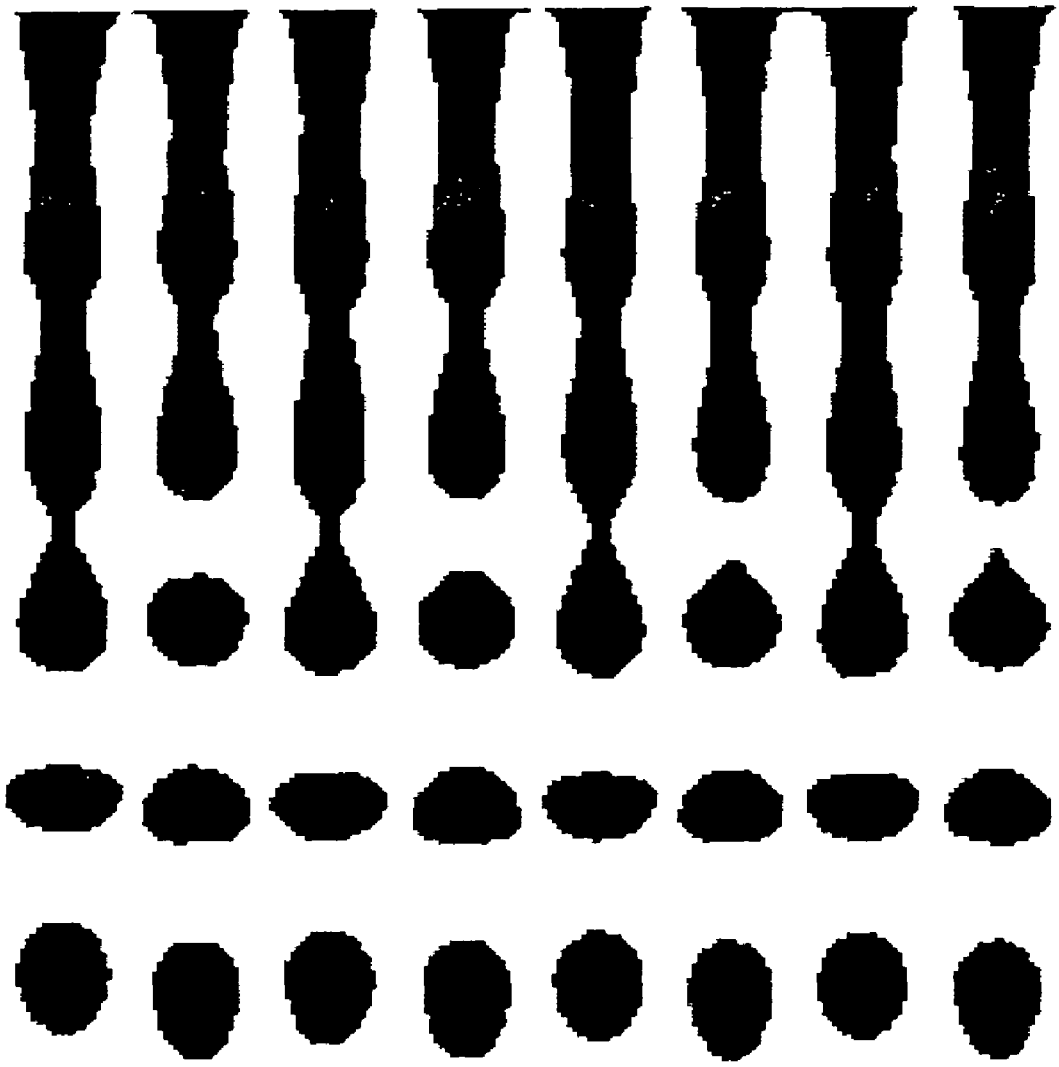
FIG. 3 depicts results of an embodiment with a differential drop break off length wherein the first group is in phase with the second group.

FIG. 3 examples the results of an embodiment of the embodied system described above. In this embodiment, a first group of nozzles are contoured and a second group of nozzles are sharp edged. The uniform stimulating device causes the ink from the two nozzles to form same size droplets with differential break off lengths between the first and second groups of nozzles. Adjacent jets differ in break off lengths by a space approximately equivalent to the space between consecutive drops from a single nozzle. FIG. 3 shows the short ink jets and the long ink jets. The same diameter nozzles with different geometries can be used to break off drops out of phase with different lengths in a manner similar to breaking off drops in phase with different lengths.

Figure 4:
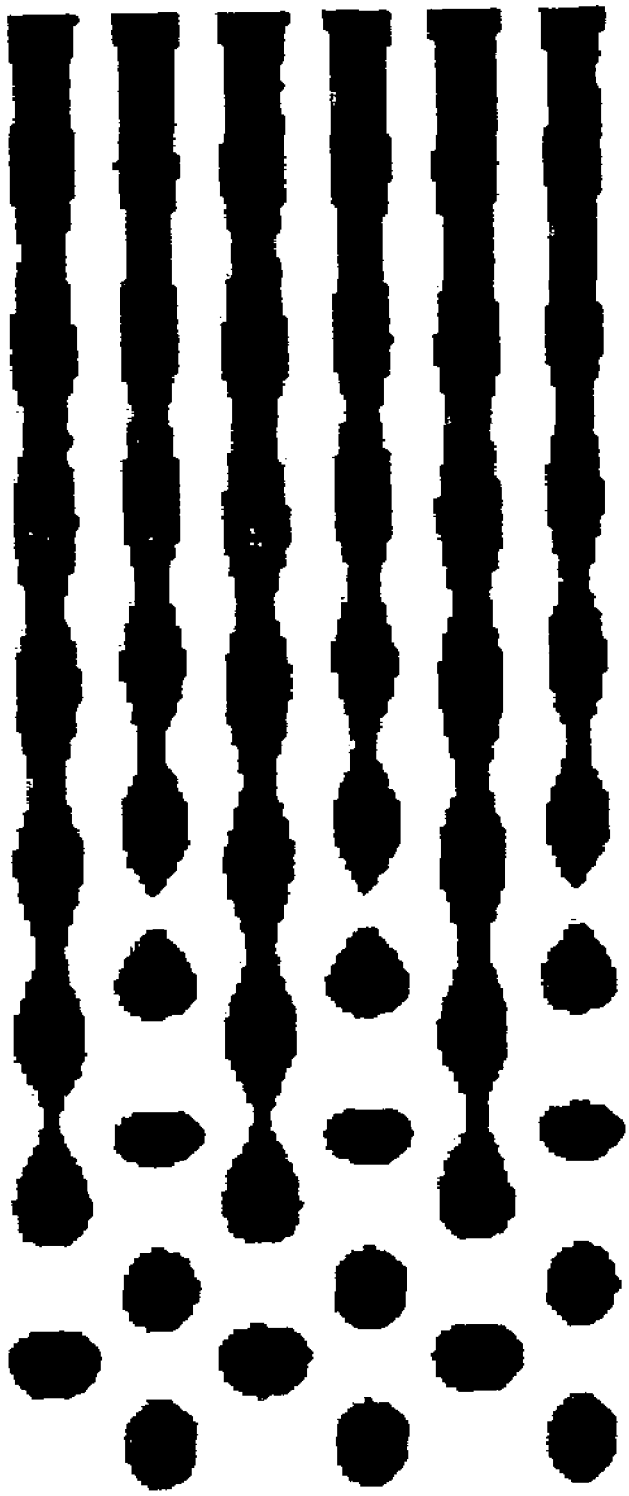
FIG. 4 depicts results of an embodiment with a differential drop break off length wherein the first group is out of phase with the second group

FIG. 4 examples the results of an embodiment of the embodied system, wherein the nozzle geometry breaks off drops out of phase with different lengths. FIG. 4 shows the short ink jets and the long ink jets. Adjacent jets differ in break off lengths by a space approximately equivalent to the 2½ times spacing between consecutive drops from a single nozzle.

Figure 5:
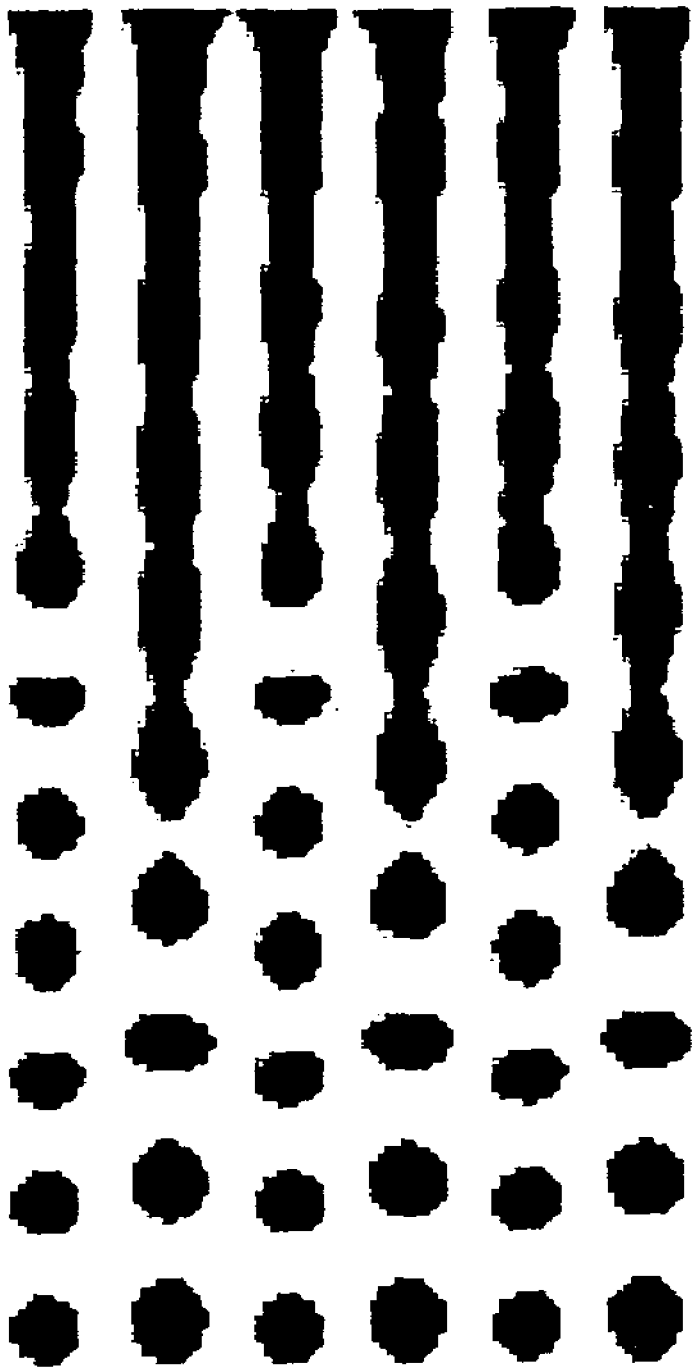
FIG. 5 depicts results of an embodiment with a differential drop break off length wherein the first group is in phase with the second group

FIG. 5 examples the results of an embodiment of the embodied system, wherein a first group of nozzles has a first length and a first droplet volume and the second group of nozzles has a second length and a second droplet volume, wherein shorter length nozzles produce drops with a shorter break off length than the longer nozzles. The array can be constructed so that the drops are in phase, but have different break off lengths. FIG. 5 shows the short ink jets and the long ink jets.

Figure 6:
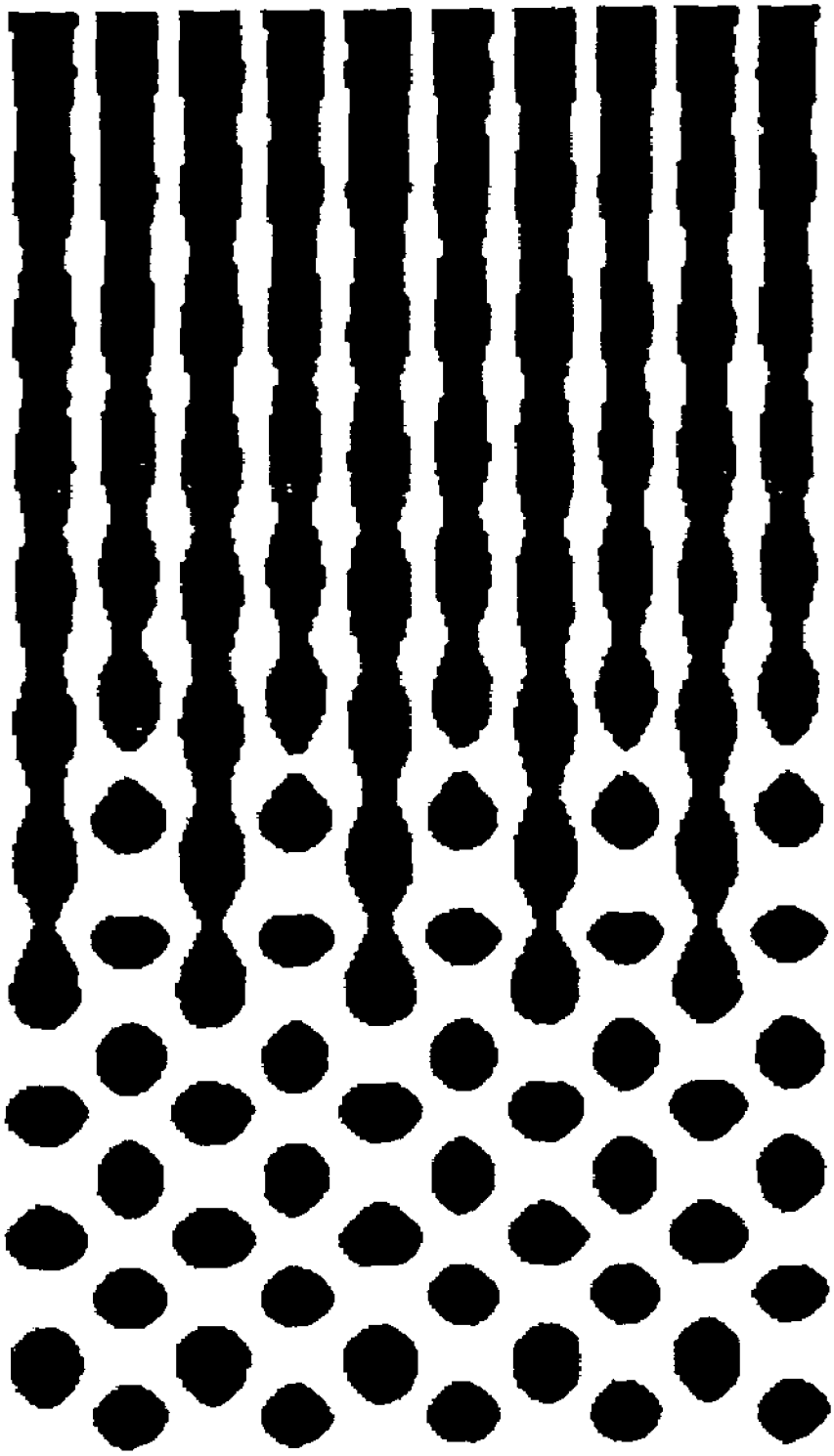
FIG. 6 depicts results of an embodiment with a differential drop break off length wherein the first group is in phase with the second group

FIG. 6 examples the results of an embodiment of the embodied system, wherein the drops are out of phase using the same nozzles as FIG. 5 with different drop break off lengths. FIG. 6 shows the short ink jets and the long ink jets. The variable jet break off lengths illustrated in FIG. 5 and FIG. 6 are the result of staggered orifice hole diameters and the resulting alternate droplet diameters.

Figure 7:
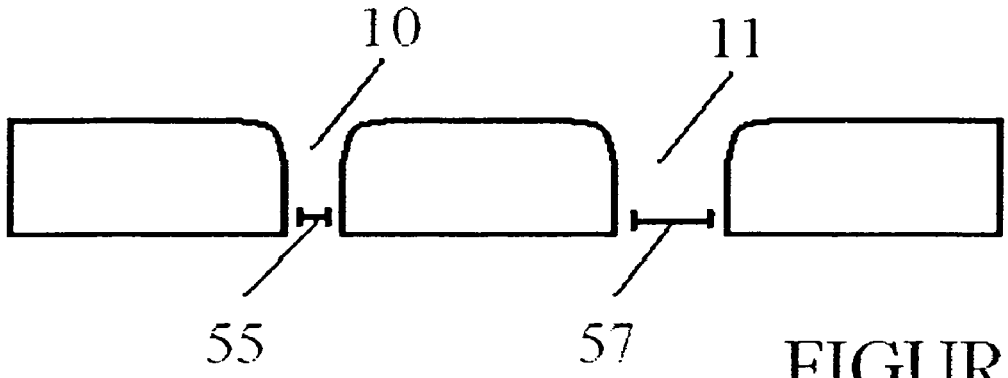
FIG. 7 depicts alternative nozzle geometries that reduce cross talk.
Figure 8:
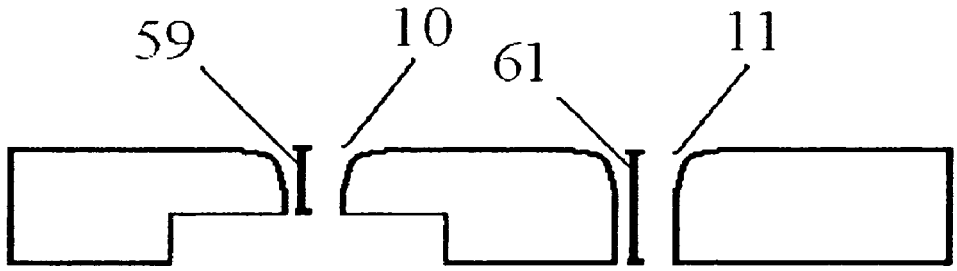
FIG. 8 depicts alternative nozzle geometries that reduce cross talk.
Figure 9:
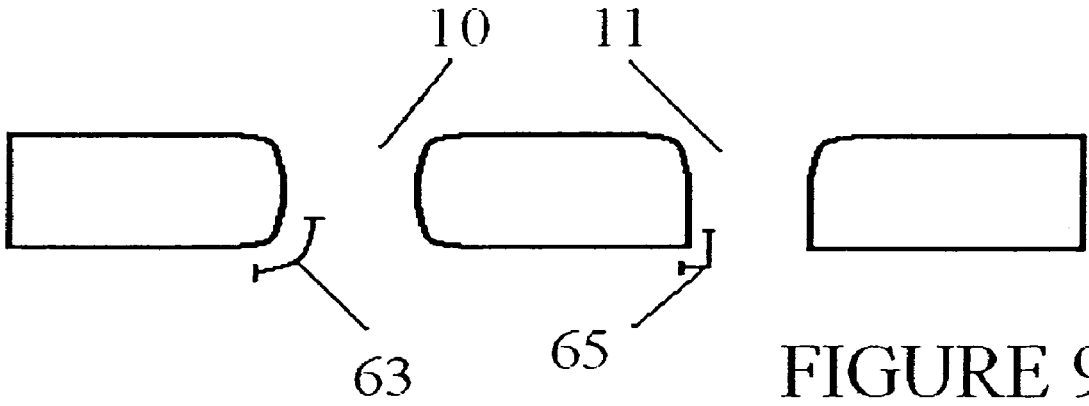
FIG. 9 depicts alternative nozzle geometries that reduce cross talk.

FIG. 7 through FIG. 9 show nozzles geometries parameters that can be varied between first group of nozzles and a second group of nozzles to produce a break off length and break off phase difference between first group of nozzles and a second group of nozzles. FIG. 7 depicts an embodiment wherein the nozzles associated with the first group of ink jets 10 can have a first diameter 55 and the nozzles associated with the second group of ink jets 11 have a second diameter 57. The diameters 55 and 57 do not have to be equal.

FIG. 8 examples the embodiment of the nozzles associated with the first group of ink jets 10 can have a first height 59 and the nozzles associated with the second group of ink jets 11 have a second height 61. Again, the nozzles heights 59 and 61 do not have to be equal. FIG. 5 depicts the first height 59 being greater than the second height 61.

FIG. 9 examples the embodiment of the nozzles associated with the first group of ink jets 10 having a first radius of curvature 63 of the nozzle exit different from the nozzles associated with the second radius of curvature 65 of the nozzle exit for the second group of ink jets 11. The nozzles can also have different radii of curvature at the nozzle entrances.

Embodied herein is a method for reducing cross talk in an ink jet printing system. The method entails forming a plurality of continuous ink jets; stimulating a first group of ink jets having a first geometry to produce a first group of drop break offs; and stimulating a second group of ink jets having a second geometry to produce a second group of drop break offs. The drops are selectively charged with electrodes on a charge plate. Each electrode is individually associated with an ink jet. The method ends by applying drop selection pluses to the drop charging electrodes enabling a first group of drops to be isolated and independent of an adjacent second group of drops.

The embodiments have been described in detail with particular reference to certain preferred embodiments thereof, but it will be understood that variations and modifications can be effected within the scope of the embodiments, especially to those skilled in the art.

PARTS LIST

7. print media
8. printhead
9. drop generator
10. continuous ink jet
11. continuous ink jet
12. continuous ink jet
13. continuous ink jet
14. electrode
14*a*. first group of drop charging electrodes
14*b*. first group of drop charging electrodes
14*c*. first group of drop charging electrodes
15*a*. first group of drop breakoff lengths
15*b*. first group of drop breakoff lengths
15*c*. first group of drop breakoff lengths
16*a*. second group of drop break off lengths
16*b*. second group of drop break off lengths
16*c*. second group of drop break off lengths
17*a*. second group of drop charging electrodes
17*b*. second group of drop charging electrodes
17*c*. second group of drop charging electrodes
19. drop
23. charge plate
24. controller
30. nozzle
31. nozzle
32. nozzle
33. nozzle
51. orifice plate
52. stimulating device
55. first diameter
57. second diameter
59. first height
61. second height
63. first radius of curvature
65. second radius of curvature

The invention claimed is:

1. An ink jet printing system comprising:

a printhead comprising a plurality of continuous ink jets, wherein the continuous ink jets are disposed in a row and directed toward a print media, wherein the printhead comprises:

a. a drop generator comprising:

i. an orifice plate disposed thereon, wherein the orifice plate comprises a plurality of nozzles with each nozzle forming an ink jet, wherein the plurality of nozzles contain a first group of nozzles and a second group of nozzles, wherein the first group is in interleaved patterns with the second group, and wherein the geometry of the first group is different from the geometry of the second group;

ii. a stimulating device adapted to provide a signal to both first group of nozzles and a second group of nozzles to produce a first group of drops with a first breakoff length and a second group of drops with a second breakoff length, wherein the first and the second breakoff lengths are different;

b. a charge plate disposed opposite the drop generator, wherein the charge plate comprises a plurality of drop charging electrodes, wherein each drop charging electrode is positioned adjacent each ink jet; and c. a controller in communication with each drop charging electrode, wherein the controller is adapted to supply a controlled drop selection pulse to each drop charging electrodes, wherein the controlled drop selection pulse applied to an electrode affect the drop selection for the adjacent ink jet and do not affect the drop selection of other jets.

2. The system of claim 1, wherein the drop charging electrodes comprises a first group of drop charging electrodes positioned adjacent the first breakoff length and a second group of drop charging electrodes positioned adjacent the second breakoff length.

3. The system of claim 1, wherein the nozzles associated with the first group of ink jets comprise a first diameter and the nozzles associated with the second group of ink jets comprise a second diameter, wherein the first diameter is greater than the second diameter, and wherein the stimulating device is adapted to vibrate the nozzles associated with both groups synchronously.

4. The system of claim 1, wherein the nozzles associated with the first group of ink jets comprise a first height and the nozzles associated with the second group of ink jets comprise a second height, wherein the first height is greater than the second height.

5. The system of claim 1, wherein the nozzles comprise a nozzle entrance, wherein the nozzles associated with the first group of ink jets comprises a radius of curvature of the nozzle entrance different from the nozzles associated with the second group of ink jets.

6. The system of claim 1, wherein the nozzles comprise a nozzle exit, wherein the nozzles associated with the first group of ink jets comprises a radius of curvature of the nozzle exit different from the nozzles associated with the second group of ink jets.

7. The system of claim 1, wherein the nozzles associated with the first group of ink jets comprise a first diameter and the nozzles associated with the second group of ink jets comprise a second diameter, wherein the first diameter is greater than the second diameter, and wherein the stimulating device is adapted to apply a pressure modulation to the ink from the nozzles of both groups.

8. The system of claim 1, wherein the nozzles associated with the first group of ink jets comprise a first height and the nozzles associated with the second group of ink jets comprise a second height, wherein the first height is greater than the second height, and wherein the stimulating device is adapted to apply a pressure modulation to the ink from the nozzles of both groups.

9. The system of claim 1, wherein the nozzles comprise a nozzle entrance, wherein the nozzles associated with the first group of ink jets comprises a radius of curvature of the nozzle entrance different from the nozzles associated with the second group of ink jets, and wherein the stimulating device is adapted to apply a pressure modulation to the ink from the nozzles of both groups.

10. The system of claim 1, wherein the nozzles comprise a nozzle exit, wherein the nozzles associated with the first group of ink jets comprises a radius of curvature of the nozzle exit different from the nozzles associated with the second group of ink jets, and wherein the stimulating devices is adapted to apply a pressure modulation to the ink from the nozzles of both groups.

11. A method for reducing cross talk in an ink jet printing system, wherein the method comprises the steps of:

a. forming a plurality of continuous ink jets;

b. stimulating a first group of ink jets having a first geometry to produce a first group of drop break offs;

c. stimulating a second group of ink jets having a second geometry to produce a second group of drop break offs;

d. selectively charging the drops with electrodes on a charge plate wherein each electrode is individually associated with an ink jet; and e. applying drop selection pulses to the drop charging electrodes enabling a first group of drops to be isolated and independent of an adjacent second group of drops.

* * * * *